US005989494A

United States Patent [19]

Kapoor

[11] Patent Number: 5,989,494

[45] Date of Patent: Nov. 23, 1999

[54] HEAT TREATABLE TUNGSTEN ALLOYS WITH IMPROVED BALLISTIC PERFORMANCE AND METHOD OF MAKING THE SAME

[75] Inventor: Deepak Kapoor, Rockaway, N.J.

[73] Assignee: The United States of America as represented by the Secretary of the Army, Washington, D.C.

[21] Appl. No.: 09/045,961

[22] Filed: Mar. 18, 1998

Related U.S. Application Data

[62] Division of application No. 08/872,975, Jun. 11, 1997.

[51] Int. Cl.[6] ..... B22F 3/24

[52] U.S. Cl. ..... 419/54; 419/49; 148/673

[58] Field of Search ..... 148/673; 419/48, 419/49, 54

[56] References Cited

U.S. PATENT DOCUMENTS

| | | | |
|---|---|---|---|
| 3,656,731 | 4/1972 | Larsen | 249/135 |
| 3,998,118 | 12/1976 | Grierson et al. | 29/182 |
| 5,603,073 | 2/1997 | Bose | 419/57 |
| 5,760,378 | 6/1998 | Christian et al. | 219/603 |

FOREIGN PATENT DOCUMENTS 449753 6/1936 United Kingdom .

OTHER PUBLICATIONS

Extrusion of Blended Powders of Tungsten–Steel and Tungsten–hafnium Composite Materials Contractor Report ARAED–CR–94010 Evan K. Ohriner Deepak Kapoor Nov. 1994.

*Primary Examiner*—John Sheehan

*Attorney, Agent, or Firm*—John F. Ploran; Michael Sachs; John E. Callagaan

[57] ABSTRACT

A tungsten heavy alloy composition comprising tungsten, iron and elements selected from the groups X, Y and Z and having the formula $W_{100-p}Fe_iX_jY_kZ_l$. Such that "X" is one or more elements selected from the group consisting of Ni, Mn and Co; "Y" is one or more elements selected from the group consisting of Cr, Mo and V; "Z" is one or more elements selected from the group consisting of C, Si, Ti and Al; "i" ranges from 5 to 19.5 weight percent; "j" ranges from 0.05 to 6 weight percent; "k" ranges from 0.15 to 5 weight percent; "l" ranges from 0.05 to 4 weight percent; and "p" is the mathematical sum of i, j, k and l, and ranges from 7 to 20 such that "100–p" ranges from 93 to 80 weight percent. The blended powder mixture thus formed is hot consolidated to full density. The hot consolidated blended powder mixture is subjected to a hardening heat treatment. The WHA composition thus formed is adiabatically shearable with flow-softening characteristics resulting in a material with superior ballistic penetration characteristics. The process of forming the composition consists of first blending quantities of iron powder with elements X, Y and Z to form a matrix of the composition. Quantities of powdered tungsten and the matrix are then blended to form a blended powder mixture which is then hot consolidated to full density. The hot consolidation temperature is selected to achieve full density but less than the intermetallic phase formation temperature between tungsten and iron, i.e. 1050° C. The preferred hot consolidation temperature is at or below 1000° C. The hot consolidated blended powder mixture is then subjected to a hardening heat treatment to form an adiabatically shearable, flow-softening WHA composition which is therefore a predicted superior performing ballistic penetrating armor piercing core material.

12 Claims, No Drawings

HEAT TREATABLE TUNGSTEN ALLOYS WITH IMPROVED BALLISTIC PERFORMANCE AND METHOD OF MAKING THE SAME

This application is a division of application Ser. No. 08/872,975 filed on Jun. 11,1997.

U.S. GOVERNMENT INTEREST

The invention described herein may be manufactured, used and licensed by or for the U.S. Government for U.S. Government purposes.

FIELD OF THE INVENTION

The present invention relates to tungsten heavy alloys (WHAs) used in armor piercing core material for medium to large calibre kinetic energy ammunition. More specifically, the present invention relates to WHAs comprised of an adiabatically shearable composition formed by hardening heat treating a hot consolidated powdered tungsten-matrix blended mixture.

BACKGROUND OF THE INVENTION

Liquid phase sintered tungsten heavy alloys (WHAs) are commonly used as the armor piercing core material/penetrator material for medium to large calibre kinetic energy ammunition used by the United States Army. These conventional WHAs are manufactured by liquid phase sintering a powder blend of tungsten and a nickel-base matrix.

Although both WHA and depleted uranium (DU) alloys are candidates for such kinetic energy penetrator (long rod) applications, the DU alloys have consistently demonstrated superior terminal ballistic performance. While increasing the strength and hardness of DU alloys significantly increase their penetrating capabilities, corresponding increases in the strength and hardness mechanical properties of WHAs do not appear to increase their penetrating capabilities. Despite the superior performance of DU alloys and tungsten-DU composites as armor piercing core material, environmental and political concerns associated with the use of depleted uranium have contributed to the Army's continuing efforts to develop a less hazardous, and environmentally more benign armor piercing core material.

Accordingly, it is an object of the present invention is to provide a depleted uranium-free armor piercing core material for kinetic energy ammunition.

Another object of the present invention to provide a depleted uranium-free armor piercing core material for kinetic energy ammunition that has performance characteristics equal to DU alloys.

A further object of the present invention is to provide a depleted uranium-free armor piercing core material for kinetic energy ammunition that has performance characteristics superior to DU alloys. Yet another object of the present invention is to provide improved penetrator tungsten heavy allow compositions by replacing the conventional nickel—base matrix with depleted uranium—free matrices.

Other objects will appear hereinafter.

SUMMARY OF THE INVENTION

It has now been discovered that the above and other objects of the present invention may be accomplished in the following manner. Specifically, the present invention provides a tungsten heavy alloy (WHA) composition comprising tungsten, iron and elements X, Y and Z. Such that "X" is one or more elements selected from the group consisting of Ni, Mn and Co; "Y" is one or more elements selected from the group consisting of Cr, Mo and V; and "Z" is one or more elements selected from the group consisting of C, Si, Ti and Al. The composition has the formula $W_{100-p}\,Fe_i\,X_j\,Y_k\,Z_l$ where "i" ranges from 5 to 19.5 weight percent; "j" ranges from 0.05 to 6 weight percent; "k" ranges from 0.15 to 5 weight percent; "l" ranges from 0.05 to 4 weight percent; and "p" is the mathematical sum of i, j, k and l, and ranges from 7 to 20, inclusive, such that "100–p" ranges from 93 to 80 weight percent. The WHA composition thus formed is hot consolidated by either hot extrusion, hot pressing or hot isostatic pressing to full density. The hot consolidated WHA composition is subjected to a hardening heat treatment which may be by martensitic transformation or precipitation hardening. The WHA composition thus formed is adiabatically shearable with flow-softening characteristics resulting in a material with superior ballistic penetration characteristics without containing depleted uranium.

The process of forming the WHA composition of the present invention consists of first blending quantities of iron powder with the elements X, Y and Z to form a matrix. Quantities of powdered tungsten and the matrix are then blended to form a blended powder mixture. The blended powder mixture is then hot consolidated at a temperature to form a full density blended powder mixture. The hot consolidation temperature selected is sufficient to achieve full density, but is less than the intermetallic phase formation temperature between tungsten and iron. The hot consolidation may be by hot extrusion, hot pressing or by hot isostatic pressing. The hot consolidated blended powder mixture is then subjected to a hardening heat treatment which may be by martensitic transformation or precipitation hardening.

DETAILED DESCRIPTION OF THE PREFERRED EMBODIMENT

Recent studies at the U.S. Army laboratories have established that it is the rate at which the penetrator material softens under the high rate, high pressure deformation it undergoes upon penetration of the target armor and not, as previously thought, the penetrator material's initial strength or ductility that establishes the penetrator material's ballistic performance characteristics.

The nature of the mechanical (strain-hardening, strain rate-hardening) and thermal (thermal-softening) properties of DU alloys has now been shown to be responsible for their superior ballistic performances compared to conventional WHA compositions with nickel-base matrices. Thus, while DU alloys retain a chiseled-nose configuration after penetration of the target armor, conventional WHA compositions usually retain a mushroomed head configuration. The chiseled-nose configuration of the DU alloys has been found to be related to deformation being localized in adiabatic shear bands, while the mushroomed head of conventional WHA compositions is related to significant plastic deformation.

It has been discovered that formation of the desired adiabatic shear bands represent an instability condition between the competing processes of work-hardening and thermal softening, i.e. desired compositions are thermomechanically less stable. This instability condition is herein termed flow-softening, and has been found to occur in WHAs when thermal softening is dominant over work-hardening. Conventional WHAs with a nickel-base matrix exhibit increasing ductility with increasing temperature and absorb a great deal of plastic deformation before achieving the desired shear localization. Tungsten based composites using DU as the matrix perform quite well as penetrators, which strongly indicates the role of the matrix in improving penetrator performance. Thus it has been discovered that WHAs based on matrices prone to flow-softening, i.e. shear localization, provide penetration performance equal, and sometimes superior, to DU alloys.

The present invention provides a plastically unstable WHA composition and method of making the same by a modification or replacement of the nickel-base matrices of conventional WHAs. Specifically, the WHA composition of the present invention has the formula:

$$W_{100-p}Fe_iX_jY_kZ_l$$

Where W is tungsten; "$Fe_i X_j Y_k Z_l$" is the matrix; Fe is iron; "X" is one or more elements selected from the group consisting of Ni (nickel), Mn (manganese) and Co (cobalt); "Y" is one or more elements selected from the group consisting of Cr (chromium), Mo (molybdenum) and V (vanadium); "Z" is one or more elements selected from the group consisting of C (carbon), Si (silicon), Ti (titanium) and Al (aluminum); "i" ranges from 5 to 19.5 weight percent; "j" ranges from 0.05 to 6 weight percent; "k" ranges from 0.15 to 5 weight percent; "l" ranges from 0.05 to 4 weight percent; and "p" is the mathematical sum of i, j, k and l, and ranges from 7 to 20, inclusive, such that "100−p" ranges from 93 to 80 weight percent. Other trace elements may also be present.

Critical issues in the selection and formation of the composition of the present invention include: the roles and interactions between the matrix and tungsten phase and the thermomechanical behavior of the overall composition; and the nucleation and growth of plastic localizations in the composition. Further, the composition of the matrix is selected so that it responds to hardening heat treatments either by martensitic transformation or via precipitation hardening. It has been found that matrices with martensitic structure or those with precipitates via precipitation hardening are thermomechanically less stable, i.e. have flow-softening characteristics, and are more prone to adiabatic shear failure than the thermomechanically stable nickel-base matrices in conventional WHAs.

It is necessary to select an optimum process of forming the WHA composition of the present invention to prevent formation of intermetallic phases in the microstructure which may result in the degradation of the mechanical properties of the tungsten alloys. Specifically, the process of forming the WHA composition of the present invention comprises the following steps. Quantities of iron powder and elements selected from the above-identified groups X, Y, and Z are blended together to form the matrix of the overall WHAs. Quantities of tungsten powder and the matrix are blended to form a blended powder mixture. The thoroughly blended powder mixture is then hot consolidated at temperatures high enough to achieve full density, but lower than the intermetallic phase formation temperature between tungsten and iron. Based on the binary phase diagram for a tungsten-iron system, this intermetallic phase starts forming at 1050° C. The preferred hot consolidation temperature is at or below 1000° C. The quantities of the elements are selected in accordance with the above-referenced formula. The hot consolidated blended powder mixture is then subjected to hardening heat treatment either by martensitic transformation or via precipitation hardening.

The matrix may be a mixture of elemental powders or a pre-alloyed powder. The blenders used to mix the tungsten powder with either elemental components of the matrix or a pre-alloyed version of the matrix are well known in the art. The powder particle size of matrix components, i.e. iron, X, Y and Z or the pre-alloyed powder made therefrom, is selected so as to have a uniform distribution of tungsten phase in a continuous and homogeneous matrix. Hot consolidation techniques are also well known in the art and include, for example, hot extrusion, hot pressing and hot isostatic pressing (HIPing). The preferred hot consolidation techniques for preparation of large quantities or larger sizes of the tungsten alloys of the present invention are hot isostatic pressing and/or hot extrusion.

The hot consolidated WHAs are further analyzed for density and are microstructurally characterized. X-ray diffraction and electron microscopic techniques are utilized to further characterize the phase formation and detailed microstructural features. Hot consolidated, fully dense WHA compositions made in accordance with the present invention are machined to fabricate test specimens for reverse ballistic testing and to screen them for the desired flow-softening characteristics. In most cases, the flow-softening or adiabatic shearable WHAs of the present invention have shown improvement in their ballistic penetration capability over the non-shearable conventional tungsten heavy alloys with a nickel-base matrix.

EXAMPLES

In the first set of examples, tungsten powder and pre-alloyed matrix powders of the composition ($Fe_{95.9}$ $Cr_{0.8}$ $Ni_{1.7}$ $Mn_{0.7}$ $Si_{0.25}$ $Mo_{0.25}$ $C_{0.4}$), ($Fe_{90.95}$ $Cr_5$ $Mo_{1.7}$ $V_{0.5}$ $Si_{1.15}$ $Mn_{0.3}$ $C_{0.4}$) and ($Fe_{84.7}$ $Cr_{11.6}$ $Mo_1$ $V_{0.7}$ $Mn_{0.3}$ $Si_{0.1}$ $C_{1.6}$) were blended to produce blends consisting of 80 and 90 weight percent of tungsten and 10 and 20 weight percent of the pre-alloyed matrix powder, respectively. The average particle size of the tungsten powder was 70 microns and the average particle size of the pre-alloyed matrix powders was about 15 microns. Another set of blends consisted of mixtures of tungsten and pre-alloyed matrix powders with compositions ($Fe_{76.5}$ $Cr_{12.5}$ $Ni_8$ $Al_1$ $Mo_2$) and ($Fe_{78}$ $Cr_{17}$ $Ni_4$ $Mn_{0.2}$ $Nb_{0.3}$ $Si_{0.5}$) were blended to produce blends consisting of 80 and 90 weight percent of tungsten and 10 and 20 weight percent of the pre-alloyed matrix powder, respectively.

All blended powder mixtures of tungsten powders and matrix phases were hot isostatically pressed (HIPed) at 1000° C., below the intermetallic phase formation temperature between tungsten and iron of 1050° C. Table 1 lists the compositions of various WHAs made in accordance with the present invention. The densities of the blended WHAs after hot consolidation were greater than 98.7% of their theoretical densities. Optical microscopy conducted on the HIPped WHAs revealed a microstructure with uniform distribution of tungsten particles in a continuous matrix phase.

Test specimens were machined out of each HIPped WHA and were subjected to appropriate hardening heat treatment. For example WHAs with carbon in their matrices were subjected to martensitic heat treatment whereas WHAs with nickel, aluminum and/or titanium in their matrices were subjected to precipitation hardening. The hardening heat treated specimens were then screened by reverse ballistic testing to characterize their flow-softening behavior as noted in Table 1.

TABLE 1

| Alloy Composition Wt. % | Process Conditions | Reverse Ballistic Screening? (Flow Softening) |
|---|---|---|
| 1. $W_{90}F_{9.6}Cr_{.08}Ni_{.17}Mn_{.07}Si_{.025}Mo_{.025}C_{.04}$ | 1000° C./4H, 30 KSI | YES |
| 2. $W_{80}Fe_{19.2}Cr_{.16}Ni_{.34}Mn_{.14}Si_{.05}Mo_{.05}C_{.07}$ | 1000° C./4H, 30 KSI | YES |
| 3. $W_{90}Fe_{9.1}Cr_{.5}Mo_{.17}V_{.05}Si_{.11}Mn_{.03}C_{.04}$ | 1000° C./4H, 30 KSI | YES |
| 4. $W_{80}Fe_{18.2}Cr_{1}Mo_{.34}V_{.1}Si_{.22}Mn_{.06}C_{.08}$ | 1000° C./4H, 30 KSI | YES |
| 5. $W_{90}Fe_{8.5}Cr_{1.1}Mo_{.1}V_{.08}Mn_{.04}Si_{.02}C_{.16}$ | 1000° C./4H, 30 KSI | YES |
| 6. $W_{80}Fe_{17}Cr_{2.2}Mo_{.2}V_{.16}Mn_{.08}Si_{.04}C_{.32}$ | 1000° C./4H, 30 KSI | YES |
| 7. $W_{90}Fe_{7.7}Cr_{1.2}Ni_{.8}Al_{.01}Mo_{.2}$ | 1000° C./4H, 30 KSI | MARGINAL |
| 8. $W_{80}Fe_{15.4}Cr_{2.4}Ni_{1.6}Al_{.2}Mo_{.4}$ | 1000° C./4H, 30 KSI | YES |
| 9. $W_{90}Fe_{7.8}Cr_{1.7}Ni_{.4}Mn_{.02}Nb_{.03}Si_{.05}$ | 1000° C./4H, 30 KSI | YES |
| 10. $W_{80}Fe_{15.6}Cr_{3.4}Ni_{.8}Mn_{.04}Nb_{.06}Si_{.1}$ | 1000° C./4H, 30 KSI | YES |
| 11. $W_{90}Fe_{7.8}Ni_{2}Ti_{.18}Al_{.02}$ | 1000° C./4H, 30 KSI | YES |
| 12. $W_{80}Fe_{15.6}Ni_{4}Ti_{.36}Al_{.04}$ | 1000° C./4H, 30 KSI | YES |
| 13. $W_{90}Fe_{7.6}Ni_{1.8}Co_{.2}Mo_{.26}Ti_{.13}Al_{.01}$ | 1000° C./4H, 30 KSI | YES |
| 14. $W_{80}Fe_{15.2}Ni_{3.6}Co_{.4}Mo_{.52}Ti_{.26}Al_{.02}$ | 1000° C./4H, 30 KSI | YES |
| 15. $W_{90}Fe_{10}$ | 1000° C./4H, 30 KSI | NO |
| 16. $W_{80}Fe_{20}$ | 1000° C./4H, 30 KSI | NO |
| 17. $W_{90}Cu_{10}$ | 1000° C./4H, 30 KSI | NO |
| 18. $W_{90}Ni_{7}Fe_{3}$ | LIQUID PHASE SINTERED | NO |
| 19. $W_{90}Ni_{10}$ | 1000° C./4H, 30 KSI | NO |

Table 1 also includes a second set of example reference compositions such as tungsten-copper, tungsten-iron, tungsten-nickel for comparison which, as noted in Table 1, do not exhibit flow-softening characteristics or adiabatic shear. See #'s 15–19, inclusive. This is as predicted within the tenants of the present invention since the matrix phase of these tungsten alloys are thermomechanically stable.

Examination of the macrostructure of one such reference composition (#18—$W_{90}$ $Ni_7$ $Fe_3$) after reverse ballistic testing revealed an undesired large plastic deformation, while a similar examination of one of the WHA compositions made in accordance with the present invention, i.e. #1—$W_{90}$ $Fe_{9.6}$ $Cr_{0.08}$ $Ni_{0.17}$ $Mn_{0.07}$ $Si_{0.025}$ $Mo_{0.025}$ $C_{0.04}$, revealed the desired flow-softening, or adiabatic shearing. As noted, those WHA compositions made in accordance with the present invention which reveal flow-softening characteristics exhibit much higher ballistic penetration as compared to those WHA compositions that do not undergo flow-softening.

In the third and final set of examples, elemental tungsten powder was blended with pre-alloyed powder having the formula $Fe_{96}$ $Cr_{0.8}$ $Ni_{1.7}$ $Mn_{0.6}$ $Si_{0.25}$ $Mo_{0.25}$ $C_{0.4}$ to form a blend consisting of 90% by weight of tungsten and 10% by weight of the pre-alloyed powder. The average particle size of tungsten was 15 microns and the average particle size of the pre-alloyed powder was 10 microns. The blended powder mixture was hot consolidated by hot extrusion at a pre-heat temperature of 1000° C., an extrusion ratio of 4:1 and by the Ceracon® process at 1000° C. The extruded and Ceracon processed blended powder mixture was fully dense. A machined and heat treated test specimen of this blended powder mixture revealed flow-softening when subjected to reverse ballistic testing.

In summary, WHAs made in accordance with the present invention with heat treatable matrix phases exhibited flow-softening characteristics and thus have a predicted improved ballistic penetration as compared to conventional WHAs. WHAs made in accordance with the present invention with heat treatable matrix phases hot consolidated at temperatures at or below 1000° C. were preferred over those hot consolidated above 1000° C. Hot consolidation temperatures above 1000° C. tended to create intermetallic phase formation between the tungsten and iron, degrading the mechanical properties of the WHAs.

While particular embodiments of the present invention have been illustrated and described, it is not intended to limit the invention, except as defined by the following claims.

I claim:

1. A method of preparing an armour piercing ammunition containing a tungsten heavy alloy (WHA) kinetic energy penetrator core material, said penetrator demonstrating adiabatic shear and flow-softening under high deformation rate and high pressure conditions, said method comprising the steps of:

(a) forming a powder mixture having in percent by weight the general formula $W_{80\text{-}93}Fe_{5\text{-}19.5}(Ni,Mn,Co)_{005\text{-}6}(C,Si,Ti,Al)_{00.5\text{-}4}(Cr,Mo,V)_{0.15\text{-}5}$ and where the amount of Fe and the amount of at least two members selected from Ni, C, Si, Ti, and Al are sufficient to provide a heat-treatable article, (b) converting the powder mixture into a dense, heat-treatable, tungsten alloy article by hot consolidation of the mixture at a temperature below the intermetallic phase formation temperature between tungsten and iron, but at a temperature at least sufficient to achieve at least 98.7% of theoretical maximum density, and (c) hardening the article with a heat treatment, (d) converting the alloy article into a WHA penetrator, and (e) assembling an armour piercing ammunition having the WHA penetrator as its core material.

2. The method of claim 1 where the hot consolidation temperature is at or below 1000 degrees C.

3. The method of claim 1 where the hot consolidation is selected from the group of hot pressing, hot isostatic pressing, and hot extrusion.

4. The method of claim 1 where the hot consolidation is selected from the group consisting of hot pressing, hot isostatic pressing, and hot extrusion, and the consolidation is sufficient to produce a fully dense, tungsten alloy article.

5. The method of claim 1 where the hot consolidation is at a temperature at or below 1000 degrees C. and is selected from the group consisting of hot pressing, hot isostatic pressing, and hot extrusion.

6. The method of claim 1 where the hot consolidation is at a temperature at or below 1000 degrees C. and is hot pressing.

7. The method of claim 1 where the hot consolidation is at a temperature at or below 1000 degrees C. and is hot isostatic pressing.

8. The method of claim 1 where the hot consolidation is hot extrusion.

9. The method of claim 1 where the hot consolidation temperature for the powder mixture is at or below 1000 degrees C. and the consolidation is selected from the group consisting of hot pressing, hot isostatic pressing, and hot extrusion and is sufficient to provide a fully dense, tungsten alloy article.

10. The method of claim 1 where the tungsten alloy article contains carbon and the hardening is a martensitic heat treatment.

11. The method of claim 1 where the tungsten alloy article contains a member selected from Ni, Al and Ti and the hardening is precipitation hardening.

12. The method of claim 1 where the powder composition has from 80 to 90 wt % W.

* * * * *